US011318630B2

(12) United States Patent
Zandsteeg et al.

(10) Patent No.: US 11,318,630 B2
(45) Date of Patent: May 3, 2022

(54) SYSTEM, APPLIANCE AND METHOD FOR AUTOMATED HAIR PROCESSING PROCEDURES

(71) Applicant: KONINKLIJKE PHILIPS N.V., Eindhoven (NL)

(72) Inventors: Cornelis Johannes Zandsteeg, Ijsselmuiden (NL); Lolke Klaas Salverda, Beetsterzwaag (NL); Roderik De Vries, Eindhoven (NL); Geert-Jan Darwinkel, Winsum (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 142 days.

(21) Appl. No.: 16/496,491

(22) PCT Filed: Mar. 26, 2018

(86) PCT No.: PCT/EP2018/057587
§ 371 (c)(1),
(2) Date: Sep. 23, 2019

(87) PCT Pub. No.: WO2018/177977
PCT Pub. Date: Oct. 4, 2018

(65) Prior Publication Data

US 2020/0023529 A1 Jan. 23, 2020

(30) Foreign Application Priority Data

Mar. 28, 2017 (EP) ..... 17163307

(51) Int. Cl.
*B26B 19/38* (2006.01)
*A45D 44/00* (2006.01)
*B26B 19/20* (2006.01)

(52) U.S. Cl.
CPC ..... *B26B 19/388* (2013.01); *A45D 44/005* (2013.01); *B26B 19/20* (2013.01)

(58) Field of Classification Search
CPC ... B26B 19/388; B26B 19/20; B26B 19/3873; A45D 44/005; A45D 24/36; Y10T 83/155
(Continued)

(56) References Cited

U.S. PATENT DOCUMENTS 5,105,541 A 4/1992 Messinger
5,964,037 A 10/1999 Clark
(Continued)

FOREIGN PATENT DOCUMENTS

WO 2013/163999 11/2013
WO 2015/063651 5/2015
WO 2016/113202 7/2016

OTHER PUBLICATIONS

International Search Report and Written Opinion dated Jun. 13, 2018 for International Application No. PCT/EP2018/057587 Filed Mar. 26, 2018.

(Continued)

*Primary Examiner* — Phong H Nguyen

(57) ABSTRACT

The present disclosure relates to an automated grooming appliance (20) for hair processing procedures, the appliance (20) comprising a processing head (58) including a blade set (22) having a processing width (36), a length setting unit (26) that is operatively coupled to the blade set (22), and a control unit (40) that is arranged to operate the length setting unit (26) based on a hairstyle model (90) that correlates position data and hair processing data, wherein the control unit (40) is arranged to adjust a length setting dependent on an actual position and an actual orientation of the blade set (22). The present disclosure further relates to an automated hair processing system (10), to a method of operating an
(Continued)

automated grooming appliance (20), and to a corresponding computer program.

17 Claims, 5 Drawing Sheets

(58) Field of Classification Search
USPC ..... 30/195, 233, 233.5, 200
See application file for complete search history.

(56) References Cited

U.S. PATENT DOCUMENTS

| | | | | |
|---|---|---|---|---|
| 6,973,931 | B1 | 12/2005 | King | |
| 8,474,466 | B2 * | 7/2013 | Lakin | B26B 19/00 132/213 |
| 8,844,142 | B2 | 9/2014 | Kammer | |
| 10,933,546 | B2 * | 3/2021 | Lauritsen | A45D 24/36 |
| 2015/0059187 | A1 | 3/2015 | Krenik | |
| 2015/0197016 | A1 * | 7/2015 | Krenik | B26B 19/388 83/13 |
| 2015/0217465 | A1 * | 8/2015 | Krenik | B26B 19/388 700/90 |
| 2015/0321365 | A1 | 11/2015 | Lauritsen | |
| 2016/0263754 | A1 | 9/2016 | Lauritsen | |
| 2018/0204346 | A1 | 7/2018 | Van Bree | |

OTHER PUBLICATIONS

The International Preliminary Report on Patentability dated Feb. 20, 2019 for International Application No. PCT/EP2018/057587 Filed Mar. 26, 2018.

* cited by examiner

SYSTEM, APPLIANCE AND METHOD FOR AUTOMATED HAIR PROCESSING PROCEDURES

CROSS REFERENCE TO RELATED APPLICATIONS

This application is the U.S. National Phase application under 35 U.S.C. § 371 of International Application No. PCT/EP2018/057587 filed Mar. 26, 2018, published as WO 2018/177977 on Oct. 4, 2018, which claims the benefit of European Patent Application Number 17163307.6 filed Mar. 28, 2017. These applications are hereby incorporated by reference herein.

FIELD OF THE INVENTION

The present disclosure relates to an automated grooming appliance for hair processing procedures, the appliance comprising a processing head including a blade set having a processing width, a length setting unit that is operatively coupled to the blade set, and a control unit that is arranged to operate the length setting unit based on a hair style model that correlates position data and hair processing data.

More specifically, the present disclosure relates to automated hair cutting appliances and to automated hair cutting systems incorporating respective appliances.

Further, the present invention relates to a method of automated hairstyle processing and to a system for automated hairstyle processing. In some embodiments, the disclosure further relates to a hair cutting appliance that may be operable in or that may form part of the system. The disclosure further relates to a corresponding computer program.

As used herein, automated hairstyle processing particularly relates to an approach that involves processing, particularly cutting, a subject's hair with an appliance that is capable of automatically adjusting a least one operation parameter, particularly a cutting length, depending on or as a function of an actual location of the appliance with respect to the individual subject. Automated hairstyle processing may be also referred to as automatic, semi-automatic or smart hairstyle processing.

The term automated hairstyle processing does not necessarily exclude any human/manual contribution or intervention. For instance, hand-held and hand-guided hair cutting appliances may be used which implement an automated adjustment of an actual cutting length. Hence, automated hairstyling within the context of the present disclosure may also be referred to as computer-aided or computer-assisted smart hairstyling.

BACKGROUND OF THE INVENTION

WO 2016/113202 A1 discloses a system for determining a relative orientation of a device to a user, comprising a first device including a first orientation measuring unit arranged to measure an orientation of the first device relative to the earth; a second device associated with the user, the second device including a second orientation measuring unit arranged to measure an orientation of the second device relative to the earth; and a processing unit arranged to calculate an orientation of the first device relative to the second device.

WO 2013/163999 A1 discloses a programmable hair trimming system comprising a hair trimming device, said hair trimming system being arranged to detect, by means of an electromagnetic tracking system, the position of the hair trimming device in relation to the head of a person on whom a hair trimming operation is being performed; relate said position to previously generated hair length profile data regarding the desired hair trimming length at various positions; and automatically and dynamically adjust the hair trimming length of said hair trimming device according to its present position and the hair length profile data. Further reference in this context is made to WO 2013/096572 A1 which discloses an automated system for cutting hair on a subject to conform to a specified style, the system comprising a hair cutting device configured to engage a cutting mechanism to cut said hair on said subject; and a positioning structure operable to interact with said hair cutting device to determine a position of said hair cutting device relative to a reference point.

WO 2015/063651 A1 discloses a similar programmable hair trimming system, the system being operable to automatically and dynamically adjust the hair trimming length according to a detected position of a hair trimming device and corresponding hair length profile data.

WO 2016/041929 A1 discloses an adjustment drive for an adjustable spacing comb for a hair cutting appliance, the adjustment drive comprising an actuator that is configured for actuating a movable comb portion of the adjustable spacing comb with respect to a blade set of the hair cutting appliance, and a proximity sensitive or touch sensitive sensor element, particularly a gesture control user input interface, wherein the sensor element is configured to detect multi-faceted user inputs applied to the sensor element and to output a user input signal that is derived from the multi-faceted user inputs, and wherein the actuator is operated on the basis of the user input signal.

Hair cutting and hairstyling are, to a great extent, manual tasks which typically require a skilled operator (hair stylist, hair dresser, etc.) who performs a haircut and/or hairstyling operation at a client. Generally, even if the client is satisfied with a particular haircut or hairstyle, the manual task needs to be performed repeatedly, for instance every four to eight weeks for relatively short haircuts. Further, even a well-experienced hairdresser or hairstylist cannot always exactly reproduce a certain haircut. The hairdresser may, on the one hand, imagine the to-be-applied haircut based on the current (grown) state of the hair. On the other hand, the hairdresser may recall and visualize the originally processed state of the previously performed haircut. Further, a client may choose and request a certain haircut by pointing at a visual representation of his/her own or other people wearing a model haircut.

Several attempts have been made to provide smart hair cutting appliances which allow a user to cut his/her hair or the hair of another person in a machine supported and controlled fashion. To this end, a hair cutting appliance may be provided which is arranged to adjust a present cutting length dependent on a certain position at the head of the person to be treated. In other words, the desired haircut is stored in a computing device which is arranged to operate the hair cutting appliance accordingly, for instance by adjusting a movable spacing comb. However, this basically requires that the model of the haircut is already stored in the computing device.

A data representation of a model haircut/hairstyle involves for instance a head topology map and a corresponding hair topology map. A head topology map may involve a three-dimensional representation of the (haired) head portion. A hair topology map may involve a corresponding length representation of the hair at the head portion. As a result, a desired hair length at certain point of the head is known. More generally, a point cloud or mesh may be provided which sufficiently describes the model haircut/hairstyle by a plurality of data sets involving positional data and associated hair property data. For illustrative purposes, aspects and embodiments of the present disclosure primarily address head hair (scalp hair) cutting and styling. However, this does not exclude an application in the field of facial hair (beard) grooming and total body grooming including intimate hair styling. Further, human hairstyling but also animal hairstyling may be addressed.

In accordance with a first approach to the preparation of hairstyle/haircut models, it has been proposed to record machine parameters of the hair cutting appliance when the haircut is actually performed, or after a haircut is performed. This may involve recording a plurality of pairs of values indicating a respective cutting length at a respective position so as to eventually generate a point cloud representing a topological hair map.

In accordance with another approach, predefined hairstyle/haircut models are generated which are not personalized but rather represent typical head shapes and therefore match a considerably large number of individuals. Hence, the hairstyle/haircut models are defined without having knowledge of the actual shape of the subject to be treated (e.g. head topology).

Further, in accordance with yet another approach, users may adopt personal hairstyle/haircut models of other individuals so as to imitate their hairstyle. The models may be exchanged, shared or downloaded via a hairstyle/haircut model marketplace, or via a data link between two respective appliances. Further, a user may simply use one and the same appliance for a number of individuals which allows to copy or transfer hairstyles and haircuts between those individuals.

However, in practical use, the above discussed approaches still show only a limited accuracy and performance. A large amount of manual intervention may be necessary so as to eventually apply someone else's hair model or even a standard non-personalized hair model to a certain individual, i.e. to another individual. There is a certain risk that the resulting hairstyle/haircut has a somewhat artificial and unattractive appearance.

Simply adopting a predefined hairstyle/haircut model and imposing it on the individual to be treated may result in an amateurish, non-professional hairstyle. Consequently, there is still a certain need for improvements in and alternative approaches to model based automated haircut/hairstyle processing It has been observed that, in practical use, automated grooming appliances and corresponding systems still have their limitations when it comes to smooth transitions and fades in the haircut. It may not be unlikely that visible defects and rather unsteady transitions may be the result of an automated hair cutting procedure when an unexperienced user is operating the appliance. A main reason for this is that the length setting unit of the appliance is basically arranged to provide and define a parallel offset between the blade set and the adjustable comb of the appliance. Hence, as typically a defined processing width of the blade set is present, a minimum range where basically all hairs are inevitably cut to the same length is present. Hence, when the appliance is oriented in an unfavorable and inconvenient fashion with respect to the intended transition, it is difficult, if not possible, to process a smooth fade or transition.

Hence, there is still room for improvement in automated haircut appliances and methods.

SUMMARY OF THE INVENTION

It is an object of the present disclosure to provide an automated hair grooming appliance and an automated hair processing system that are capable of processing smooth fades and transitions. Preferably, the automated grooming appliance is operable also for non-experienced users. It would be further preferred that unintended visible defects and discontinuities in the processed hairstyle shape may be minimized or even avoided.

Further, preferably, the automated grooming appliance shall be easy to operate, despite of the desired enhanced features.

It would be further preferred to present a corresponding method of operating an automated grooming appliance, and a corresponding computer program.

In a first aspect of the present disclosure there is presented an automated grooming appliance for hair processing procedures, the appliance comprising:

a processing head including a blade set having a processing width, a length setting unit that is operatively coupled to the blade set, and a control unit that is arranged to operate the length setting unit based on a hairstyle model that correlates position data and hair processing data, wherein the control unit is arranged to adjust a length setting dependent on an actual position and an actual orientation of the blade set.

This aspect is based on the insight that the blade sets of grooming appliances as such have a certain extension, particularly a defined processing width or cutting width. Along the extension of a leading or cutting edge of the blade set, basically one and the same length setting is provided. In other words, generally an adjustable comb that is present in an automated grooming appliance is defining a basically parallel offset from the blade set. In this way, a basically constant cutting length along the extension of the blade set may be provided which results in a basically constant and steady hair length. This is, on the one hand, beneficial for constant cutting length portions. However, on the other hand, when transitions and fades are to be processed, having a constant cutting length setting is somewhat problematic.

It has been observed that, depending on the actual orientation of the blade set, processing fades and smooth transitions may be somewhat compromised as basically only one and the same cutting length setting is provided along the extension of the blade set.

For this reason, it is proposed in accordance with certain embodiments as discussed herein to make the length setting of the automated grooming appliance not only dependent on an actual position of the blade set but also on an actual orientation. Hence, it would be desirable to detect and track not only the current position of the blade set, but also the current orientation of the overall appliance. As a consequence, when setting the length adjustment feature, it may be determined whether or not any section of the overall extension of the blade set, to which the adjustable comb is coupled, is placed in such a way that the intended haircut may be processed and, first and foremost, that preferably no hair portion is actually cut too short.

Hence, when the control unit operates the length setting unit dependent on the actual position and on the actual orientation of the blade set, it is possible to observe the effective present cutting width when defining the actual cutting length.

In some exemplary embodiments, the length setting is set under consideration of the position and the orientation of the blade set of the appliance with respect to a user to account for a non-constant length provided by the hairstyle model for a current operating zone along the extension of the blade set.

Generally, the automated grooming appliance may be arranged as an automated hair cutting and/or hair styling appliance. Typically, the appliance comprises a housing that defines a handle or hand piece. Further, at a top end of the housing, a processing head or cutting head is provided. The processing head is equipped with the blade set. Generally, the blade set may comprise a stationary blade and a movable blade. The stationary blade may generally be referred to as guard blade. The movable blade may generally be referred to as cutter blade. In addition, a length setting unit is provided, or operatively coupled, that may be arranged as a motorized or powered length setting unit. Hence, the length setting unit operates or actuates an adjustable comb that is arranged to space the blade set, particularly a leading edge thereof, away from the skin of the haired portion of the user that is to be processed.

The control unit may be provided at or integrated in the automated grooming appliance. Further, in the alternative, the control unit may be operatively coupled to the grooming appliance. By way of example, the automated grooming appliance may be provided with a control interface, particularly a wireless interface. Hence, a separate control device having considerable processing capacity may be provided. For instance, a mobile phone, a mobile computer, a tablet computer, etc. may be provided to act as a control device that implements the control unit. Further, in the alternative, the task of controlling the length setting unit may be a distributed task. Hence, the control unit may be distributed and embodied/formed by distributed entities that may be present, on the one hand, at the grooming appliance and, on the other hand, at a separate computing device.

In an exemplary embodiment of the appliance, the hairstyle model involves a hairstyle map that includes a head topology and an assigned hair length setting that represents a model haircut. Hence, when an actual position of the grooming appliance is detected, the length setting unit may be operated accordingly to set the currently required length setting. In accordance with the above aspect, the actual length setting that is to be set is not only dependent on the actual position (single pair of values), but also on the actual orientation. Hence, more than one pair of values (each representing a certain point at the extension of the blade set and a corresponding hair length, for instance) may be used to define the currently required length setting.

In yet another exemplary embodiment of the appliance, the control unit is operable to set the length setting unit to a selected value of a number of observed length values provided by the hairstyle model for the actual position and orientation, and for a given width of the blade set. Hence, the risk that a length value is selected based on a single pair of values that is eventually too short is greatly reduced.

In a further exemplary embodiment of the appliance, the control unit is operable to set the length setting unit to a selected value of a series of length values provided by the hairstyle model that are distributed along a processing width extension of the blade set. When the actual orientation of the blade set is detected and/or otherwise derived, more than only one pair of values may be obtained from the hairstyle model to seek for the desired setting.

Generally, the processing width of a blade set of a processing head of a grooming appliance is defined by a basically linear leading (or at least slightly curve) edge where a series of corresponding stationary blade teeth and movable blade teeth is provided, respectively. However, this shall not be interpreted in a limiting sense. Hair grooming appliances are known that incorporate blade sets that are provided with considerably curved or circular shapes, radially extending teeth, and corresponding leading edges. Hence, the above general insights may be applied thereto as well.

In a further exemplary embodiment of the appliance, the selected value is a maximum value of any observed value for the width extension of the blade set. This has the effect that in a transition zone, on the one hand, in the currently processed region, at least some portions of the hair are not necessarily cut to the desired length. However, on the other hand, it is avoided in this way that considerably large portions are actually cut too short.

In still another exemplary embodiment of the appliance, the control unit is operable to adjust the length setting based on an evaluation of two or more length values provided by a hairstyle model for the actual position, orientation and processing width extension of the blade set. Preferably, lateral ends and a central region of the blade set are observed to evaluate two or more respective length values provided by the hairstyle model.

In a further exemplary embodiment of the appliance, the control unit is operable to adjust the length setting based on an evaluation of three or more length values, wherein a first length value of the length values is assigned to a first lateral end of the blade set, wherein a second length value of the length values is assigned to a second lateral end of the blade set, wherein a third length value of the length values is assigned to a central portion of the blade set between the first lateral end and the second lateral end, and wherein a maximum value of the first length value, the second length value and the third length value is used to set the length setting unit.

In this way, transitions in the hair interfering with the present processing width of the blade set may be observed and considered when defining the actual length value that is to be set.

In a further exemplary embodiment of the appliance, the control unit is operable to be provided (or supplied) with position information provided by a position detection unit. Generally, the actual position of the appliance, particularly of the blade set with respect to the actual user and with respect to the stored hairstyle model is of interest. This may further involve that a current shape of the user, for instance a head/scalp shape, is correlated with a model shape so as to map the stored hairstyle model thereto.

Further, in another exemplary embodiment of the appliance, the control unit is operable to be provided (or supplied) with orientation information supplied by an orientation detection unit. Again, absolute orientation information and/or relative orientation information may be of interest.

Generally, when not only a current position but also a previous movement of the appliance is tracked and recorded, the actual orientation of the blade set may be detected based on an evaluation of a current movement direction or vector of the appliance. This approach may be based on the insight that a movement direction of the blade set is basically perpendicular to the width extension thereof.

As a consequence, orientation detection is considerably easy to implement as no additional sensors are required. In other words, the position detection unit may be operated as orientation detection unit as well. However, this shall not be interpreted in a limiting sense.

In the alternative, extended sensors may be provided in such a way that the orientation detection unit may detect an actual orientation of the appliance without the need of analyzing previous movements.

Further, in accordance with another embodiment, a combined approach may be implemented that uses direct orientation detection and mediate orientation detection.

Further, more generally, the position detection unit and the orientation detection unit may be formed by one and the same detection unit.

In yet another exemplary embodiment, the appliance further comprises a hand piece arranged to be moved through hair to cut hair, wherein the processing head is formed at or attached to the hand piece. Hence, the appliance may be a hand-held appliance as it is ensured that a potentially unsuitable and improper orientation of the appliance does not have an adverse effect on transitions, fades and further regions where the hair length is changing.

In a further aspect of the present disclosure, there is presented an automated hair processing system, the system comprising a grooming appliance in accordance with at least one embodiment as described herein, a position detection unit that is arranged to detect and track a position and an orientation of the appliance with respect to a user, and a control device that is arranged to correlate position information and orientation information with a present hairstyle model. In some exemplary embodiments, the length setting is set under consideration of the position and the orientation of the blade set of the appliance with respect to a user to account for a non-constant length provided by the hairstyle model for a current operating zone along the extension of the blade set.

The hair processing system may further comprise a computing device which may be formed, for instance, by a mobile phone, a tablet computer, a mobile computer, etc. that is coupled to the position detection unit and to the grooming appliance. However, in alternative embodiments, the automated hair processing system is arranged, in terms of data processing, as a standalone system that does not necessarily need to be operatively coupled to a separate computing device. Hence, at least one of the grooming appliance and the position/orientation detection unit may be provided with sufficient computing capacity to operate and control the hair processing system.

In still another aspect of the present disclosure there is presented a use of an automated grooming appliance in accordance with at least one embodiment as described herein in a hair cutting procedure for processing a length transition region. Hence, using the appliance, it may be ensured that, regardless of an actual orientation of the appliance with respect to the desired haircut/hairstyle, smooth transitions and fades may be provided.

In a further aspect of the present disclosure there is presented a method of operating an automated grooming appliance, the method comprising the following steps:

providing a grooming appliance comprising a processing head including a blade set having a processing width, and a length setting unit that is operatively coupled to the blade set, and controlling the length setting unit based on a hairstyle model that correlates position data and hair processing data, wherein the step of controlling involves adjusting a length setting dependent on an actual position and an actual orientation of the blade set.

In an exemplary embodiment of the method, there is further provided the step of setting the length setting unit to a selected value of a series of length values provided by the hairstyle model that are distributed along a processing width extension of the blade set, wherein the selected value is a maximum value of any observed value.

Hence, at a particular time, two, three or even more values that are distributed along the present width extension of the blade set are observed to select the maximum thereof that defines the length setting of the adjustable comb that is arranged at the appliance.

In yet another aspect of the present invention there is provided a computer program which comprises program code means for causing a computing device to perform the steps of the methods as discussed herein when said computer program is carried out on that computing device.

The program code can be encoded in one or more non-transitory, tangible media for execution by a computing machine, such as a computer. In some exemplary embodiments, the program code may be downloaded over a network to a persistent memory unit or storage from another device or data processing system through computer readable signal media for use within the system. For instance, program code stored in a computer readable memory unit or storage medium in a server data processing system may be downloaded over a network from the server to the system. The data processing device providing program code may be a server computer, a client computer, or some other device capable of storing and transmitting program code.

As used herein, the term "computer" may stand for a large variety of processing devices. In other words, also mobile devices having a considerable computing capacity can be referred to as computing devices, even though they provide less processing power resources than standard "computers". Needless to say, such a "computer" can be part of a personal care device and/or system. Furthermore, the term "computer" may also refer to a distributed computing device which may involve or make use of computing capacity provided in a cloud environment. The term "computer" or "computing" may also relate to medical technology devices, health tech devices, personal care devices, fitness equipment devices, and monitoring devices in general, that are capable of processing data. Any automated information processing device or system capable of processing respective data may be referred to as computing device.

Preferred embodiments of the disclosure are defined in the dependent claims. It should be understood that the claimed method and the claimed computer program can have similar preferred embodiments as the claimed system and the claimed appliance and as defined in the dependent system/appliance claims, and vice versa.

BRIEF DESCRIPTION OF THE DRAWINGS

These and other aspects of the invention will be apparent from and elucidated with reference to the embodiments described hereinafter. In the following drawings

DETAILED DESCRIPTION OF THE INVENTION

Figure 1:
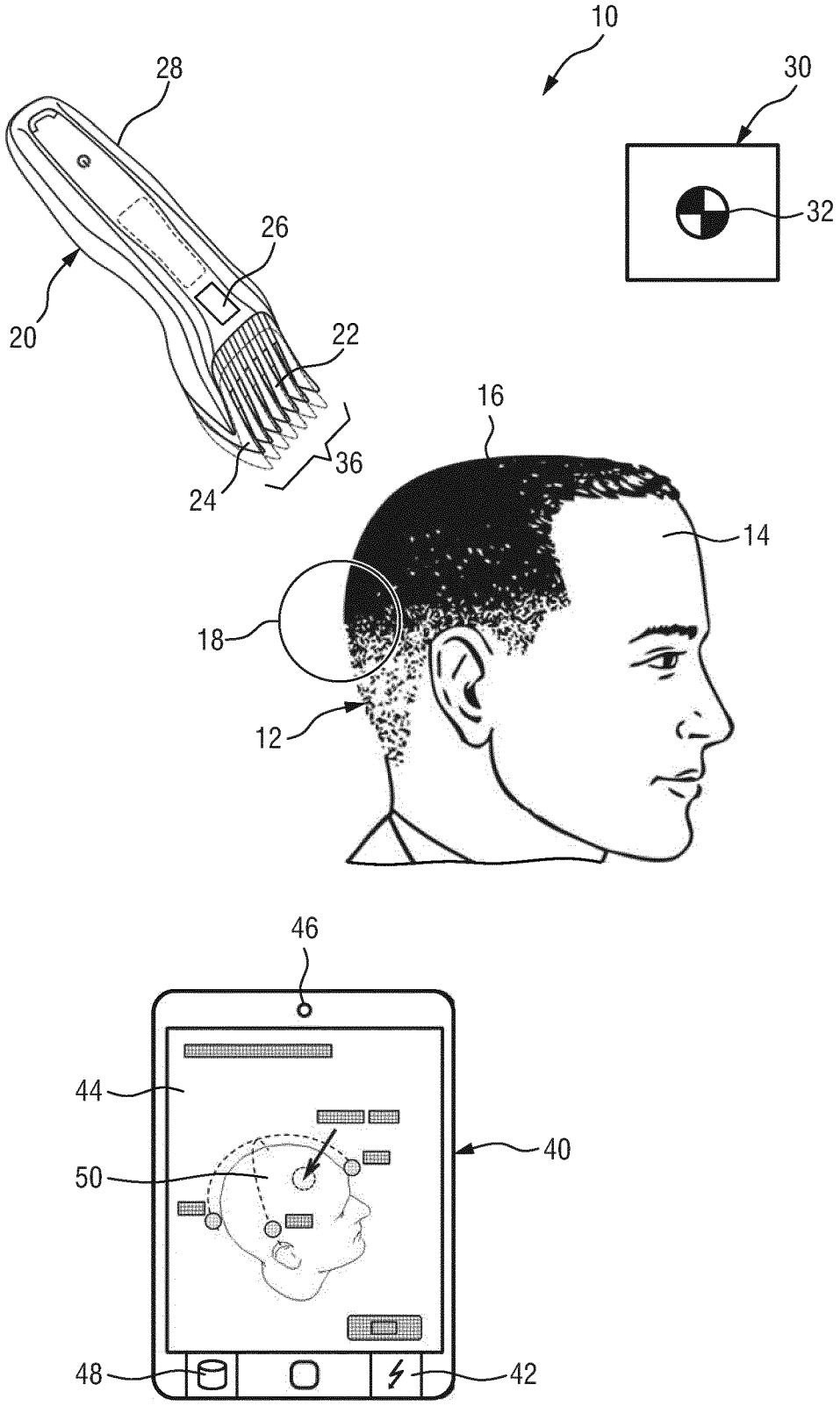
FIG. 1 shows a simplified general layout of an exemplary embodiment of an automated hairstyle processing system.

FIG. 1 shows a simplified schematic illustration of an automated hairstyle processing system 10. The hairstyle processing system 10 may also be referred to as automated haircut processing system. The system 10 is arranged to perform a haircut or hairstyling operation at a client or subject 12, wherein the system 10 is capable of reproducing a previously defined haircut or hairstyle on demand. In FIG. 1, a haired portion 16 at a head or scalp portion 14 of the subject 12 is illustrated. The system 10 is arranged as a "smart" hair cutting or hair styling system.

A hair length transition region of the hair portion 16 is indicated by 18. Similarly, a fade may be present at the transition between the hair and the neck region, for instance. In some hairstyles, it is desired to have a considerably smooth fade so that no clear and sharp edge between the haired portion 16 and the neck or another head portion is visible.

As already indicated further above, the present disclosure generally relates to grooming, processing and styling human hair and animal hair which involves head hair and body hair.

The system 10 comprises a hair cutting appliance 20 which may also be referred to as automated hair cutting appliance. The appliance 20 is arranged as a hand-held or hand-guided appliance. The appliance 20 may be basically arranged as a hair cutting appliance which is supplemented by additional processing and control capabilities. Generally, the appliance 20 may be grasped by a user and operated so as to cut hair at the subject 12. This may involve moving the appliance 20 through the haired portion 16 at the head portion 14 of the subject 12 and cutting hairs to a desired length.

The appliance 20 may be held and operated by the subject 12 itself (whose haircut is to be processed). In the alternative, the appliance 20 may be operated by another individual. The operator of the hand-held appliance 20 shall be referred to hereinafter as the user.

Figure 4:
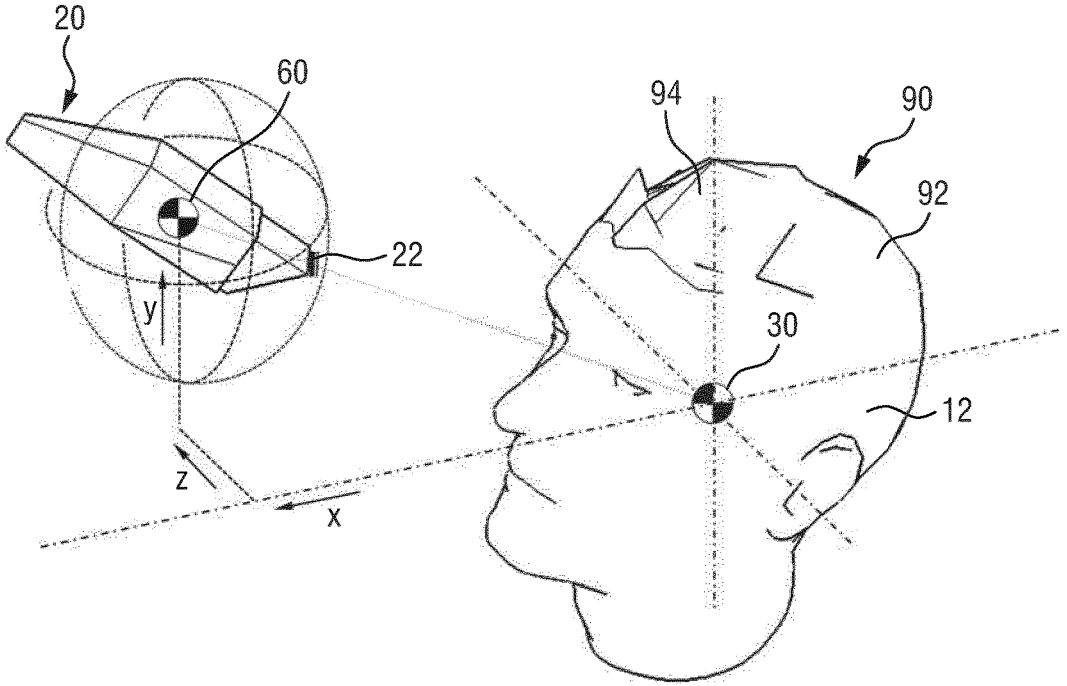
FIG. 4 shows a simplified schematic perspective representation of a head of a subject of interest in relation to which a hand-held appliance for haircut processing is arranged.

The appliance 20 comprises a blade set 22 which is not explicitly shown in FIG. 1 (refer also to the alternative representation of the appliance 20 in FIG. 4). In FIG. 1, the blade set 22 is covered by a comb 24. The comb 24 may be also referred to as adjustable spacing comb. Further, a length setting unit 26 is provided at the appliance 20. For instance, the length setting unit 26 is arranged to operate and adjust the comb 24 so as to define an actual cutting or trimming length of the appliance 20. The comb 24 defines an offset between a skin or scalp level at the subject 12 and a cutting edge of the blade set 22.

Hence, the length setting unit 26 may be controlled and operated so as to control the comb 24 dependent on an actual position of the appliance 20 with respect to the haired portion 16 of the subject 12. Consequently, assuming that an appropriate control based on a hairstyle model involving position data and hair cutting length data is provided, the user may adequately trim and style the subject's 12 hair, even in the absence of professional hairstyling knowledge.

The appliance 20 comprises a housing that defines a hand piece 28. Hence, the appliance 20 may be referred to as hand-held and/or hand-guided appliance.

At a front end of the blade set 22, an effective processing width 36 is present. The processing width 36 defines the range that may be processed in one stroke (push or pull movement) of the appliance 20 through hair.

The system 10 further comprises a position detection unit 30 which may be also referred to as tracking unit or position/orientation detection unit. The position detection unit 30 is indicated in FIG. 1 by a simplified bock. The unit 30 comprises a positional reference 32. There exist several embodiments of the position detection unit 30. Reference is made again to WO 2013/163999 A1 in this context. Generally, the main purpose of the position determination unit 30 is to detect a current position of the appliance 20 with respect to the haired portion 16 or the head portion (scalp) 14 of the subject 12. Consequently, the actual position of the appliance 20 with respect to the subject 12 may be assigned to a respective hair property value, particularly to a hair length value which enables an automated hair processing wherein the length setting unit 26 of the appliance 20 ensures a correct setting of the comb 24 so as to eventually achieve the desired hair length.

Further, the position detection unit 30 may be arranged to detect an actual orientation of the appliance 20 with respect to the haired portion 16 or the head portion (scalp) 14 of the subject 12. In this way, not only an actual position of the appliance 20, but also directional information (e.g. directional vector information) may be detected.

Hence, the position detection unit 30 in accordance with this embodiment may be referred to as a combined position and orientation detection unit 30.

In certain embodiments, the orientation information may be obtained in a mediate fashion from previously obtained (historical) data. That is, when a position path of the appliance 20 is tracked and recorded, conclusions regarding an assumed orientation of the appliance 20 may be drawn therefrom. This is based on the insight that the appliance 20 is generally moved in a typical moving/advancing direction that is basically perpendicular to the operating width extension of the blade set of the appliance 20. Hence, when a moving vector is detected, orientation indicative information is provided.

As exemplarily shown in FIG. 1, also a control device 40 may form part of the system 10. This may be for instance the case when the appliance 20 as such does not provide sufficient data processing and computing capacity. Generally, the control device 40 may be referred to as control unit or computing device. The device 40 may be arranged as a mobile device, for instance a tablet computer, a mobile phone and such like. The device 40 comprises a processing unit 42 including at least one processor (CPU) arranged to process operational data for the system 10.

Further, user feedback units 44, 46 may be provided so as to establish an interaction between the user and the hair cutting appliance 20 via the computing device 40. For instance, the user feedback units may comprise a display or screen 44, and speakers 46. The computing device 40 may further comprise a memory unit 48 which may be arranged to store hairstyle and/or haircut models. Further operational data may be stored in the memory unit 48. In FIG. 1, visual information 50 is displayed on the screen 44. This may further facilitate operating the hair cutting appliance 20.

As will be discussed further below, the hair cutting appliance 20 and the computing device 40 are preferably arranged to exchange data therebetween. This may for instance involve a wireless and/or a cable communication.

There are further embodiments of the system 10 wherein the hair cutting appliance 20 as such provides sufficient computing capacity. However, also if this is the case, providing the computing device 40 may be beneficial for a setup and further configuration operations.

Figure 2:
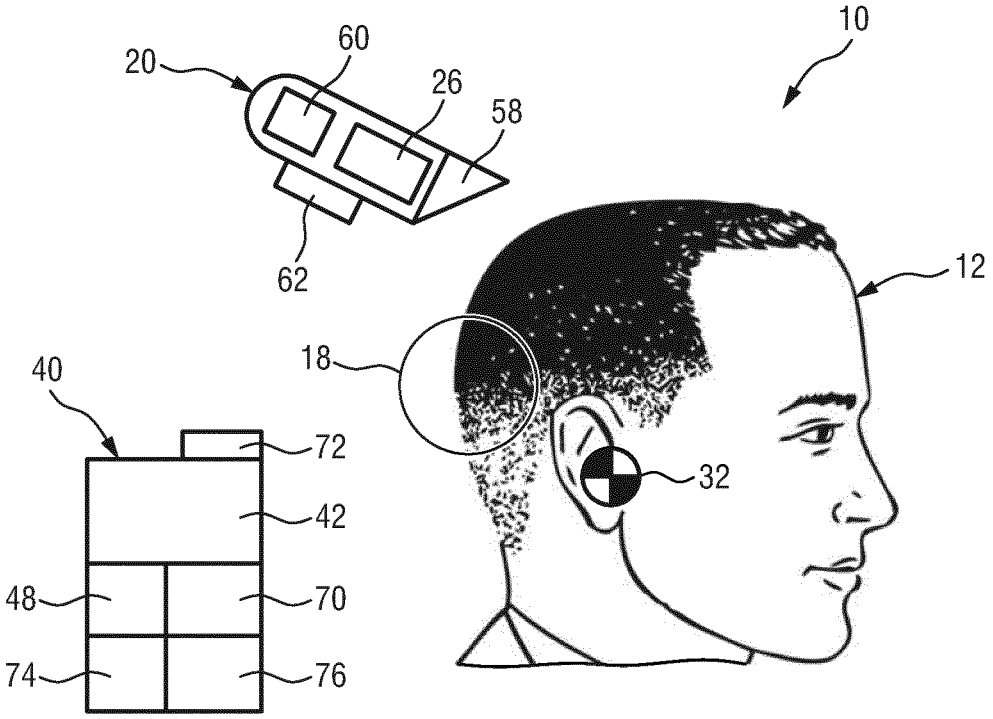
FIG. 2 shows another alternative layout of an embodiment of an automated hairstyle processing system.
Figure 3:
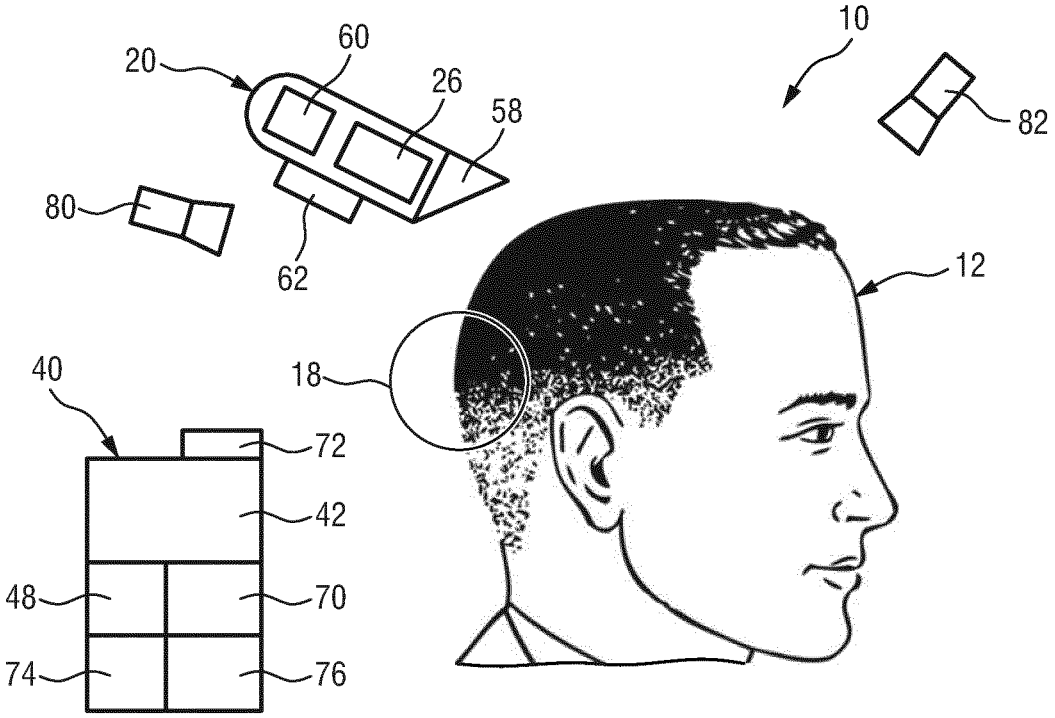
FIG. 3 shows yet another exemplary layout of an embodiment of an automated hairstyle processing system.

FIG. 2 illustrates an exemplary embodiment of an automated hairstyle processing system 10 which may generally correspond to the embodiment already explained above in connection with FIG. 1. Further, FIG. 3 illustrates yet another exemplary embodiment of an automated hairstyle processing system 10 having a general layout which also basically corresponds to the layouts as illustrated in FIGS. 1 and 2.

In FIG. 2, the system 10 comprises a hand-held hair cutting appliance 20 implementing a length setting unit 26. The length setting unit 26 is operatively coupled with a cutting head or processing head 58. Typically, the processing head 58 involves a comb 24, refer also to FIG. 1. The length setting unit 26 controls an actual state of the processing head 58 so as to set an actual cutting length. The appliance 20 further comprises a position/orientation indicating section 60. The section 60 allows to detect a current (absolute or relative) position of the appliance 20 and to track a movement path of the appliance 20 accordingly. Hence, when the appliance 20 is moved along the subject's 12 scalp, an actual shape of the head or scalp of the subject 12 is sampled, captured or scanned. In this way, a model of the actual shape of the to-be-treated portion of the subject 12 may be obtained.

In some embodiments, the position/orientation indicating section 60 is operable to cooperate with a positional reference 32. In FIG. 2, the positional reference 32 is a wearable reference worn by the subject 12. For instance, an ear wearable reference as disclosed in WO 2013/163999 A1 may be utilized. Consequently, a relative position of the appliance 20 with respect to the positional reference 32 may be detected and tracked. Hence, a current position of the appliance 20 at the head of the subject 12 can be processed.

The appliance 20 further comprises a control interface 62 through which data and information may be exchanged. In one embodiment of the system 10, the appliance 20, the position determination unit 30 and the computing device 40 (refer also to FIG. 1) are arranged to communicate with one another, preferably in a wireless fashion. Consequently, also the computing device 40 shown in FIG. 2 may comprise a control interface 72. Between the control interface 62 and the control interface 72, a data transfer link may be established. In addition, also the positional reference 32 or the position determination unit 30 as such, may be provided with a corresponding control interface (not shown in FIG. 2).

Hence, a sampling unit 74 of the computing device 40 may be supplied with samples which involve the actual position of the appliance 20 with respect to the positional reference 32 and, consequently, with respect to the subject 12. Hence, by moving the appliance 20 along and in close proximity to the head of the subject 12, a virtual data representation of the actual shape thereof may be obtained. In other words, assuming that a certain sampling rate is used, a point cloud, data mash or data set may be generated which represents the shape of at least a part of the head 14.

The computing device 40 as shown in FIG. 2 further comprises a model adaption unit 70 and a deviation detection unit 76. The deviation detection unit 76 is arranged to perform a nominal-actual comparison so as to assess whether an actual shape of the treatment portion of the subject 12 sufficiently corresponds to the predefined model based on which the hairstyle model is generated. As indicated above, the appliance 20 may be operated based on the hairstyle model so as to ensure an automated hair cutting action.

In case the deviation detection unit 76 detects a significant deviation, for instance a considerable protrusion or depression at the scalp of the subject 12, the model adaption unit 70 may adapt the hairstyle model accordingly so as to ensure the desired overall appearance and accuracy of the haircut.

The computing device 40 of FIG. 2 is further provided with a memory unit 48 which is arranged to at least temporarily store a predefined hairstyle or haircut model and, if necessary, an adjusted or adapted hairstyle/haircut model which is assigned to the actual (individual) subject 12.

The arrangement of FIG. 3 basically differs from the arrangement of FIG. 2 in that remote visual position sensors 80, 82 are provided for position/orientation detection. For instance, video cameras may be provided so as to monitor the subject 12 and the appliance 20 from different positions so as to enable a three-dimensional tracking of the position (and orientation) of the appliance 20 with respect to the head or scalp of the subject 12. Images obtained by the position sensors 80, 82 may be processed so as to detect and track the requested position (e.g., contact of appliance 20 and scalp) accordingly. Also in this way, a current position of the appliance 20 may be detected and sampled so as to generate an actual representation of the shape of the head or scalp of the subject 12. Further, an actual orientation of the appliance 20 and particularly of the blade set 22 thereof may be detected.

Needless to say, remote position sensors as illustrated in FIG. 3 and wearable positional references as illustrated in FIG. 2 may be combined so as to further improve the position detection performance. The position determination unit 30 used in the embodiment of FIG. 2 may for instance involve an electromagnetic field (EMF) position detection sensor.

FIG. 4 exemplarily illustrates a simplified model representation of a subject's 12 head. Further, a coordinate system is indicated in FIG. 4 by dot-dashed lines. Arrows indicated by X, Y and Z indicate respective directions. A (virtual) origin of the coordinate system of FIG. 4 is for instance in the center of the head of the subject 12. Consequently, a hairstyle or haircut model 90 may be defined with reference to the coordinate system X, Y and Z. The hairstyle model 90 may be also referred to as hair topology model.

The hairstyle model 90 involves a scalp or head model 92 describing a model shape of the subject 12, i.e. at the level of the skin or scalp. The hairstyle or haircut model 90 further involves a hair length model 94 which may be also referred to as hair property model. The hair length model 94 involves respective hair length values associated with respective positions at the model 92 representing a skin or scalp contour of the subject 12. The scalp model 92 and the hair length model 94 jointly form the hairstyle model 90. Hence, when performing a hair cutting operation, the position determination unit 30 (FIG. 1) and the position/orientation indicating section 60 detect and track an actual position of the appliance 20 based on which an actual (length) setting of the appliance 20 may be adjusted and controlled. This feature also may be used to generate an actual model of a to-be-treated individual. Hence, scanning or sampling the head or scalp topology may be considered as a reverse scanning or reverse sampling approach using structural features which are anyway provided in a smart hairstyle processing system 10.

Figure 5:
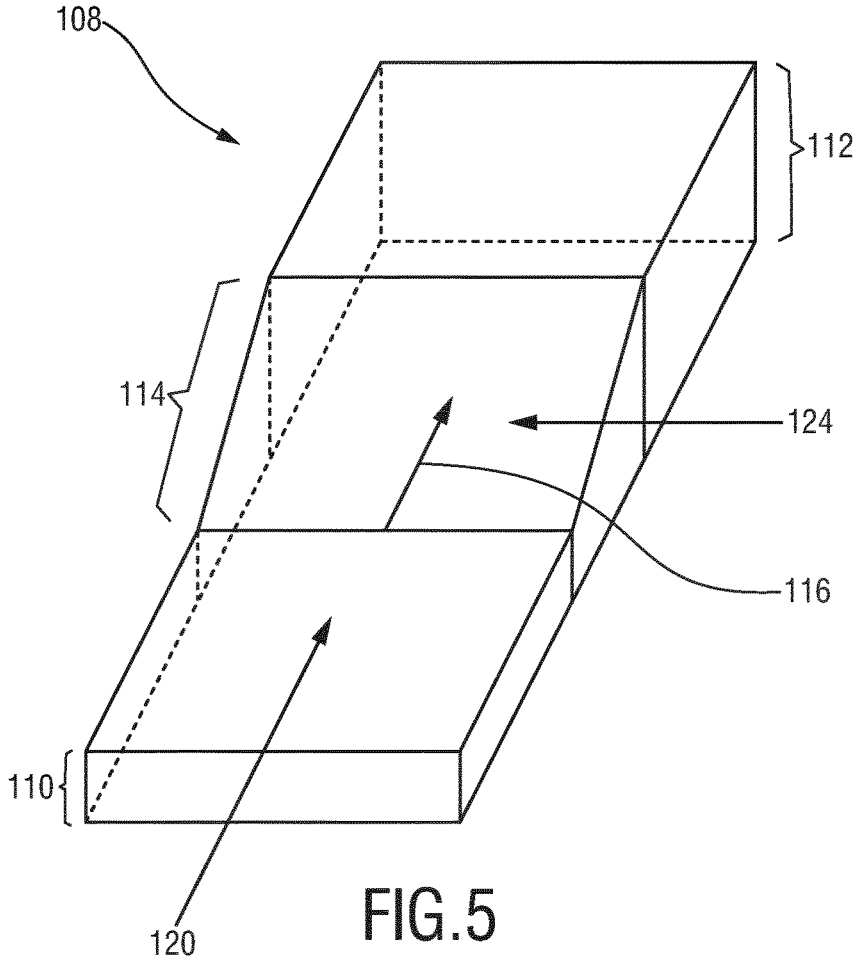
FIG. 5 shows a perspective simplified section of a hair property model representing hair lengths along a defined area, wherein a length transition is present in the observed area.

FIG. 5 is a simplified perspective schematic view of a section of a hair length model 94 as discussed herein before. The haired portion is indicated by 108.

For illustrative purposes, the haired portion 108 includes an area having short hair 110, an area having long hair 112, and a transition 114 therebetween. For instance, the haired portion 108 may represent a transition between a top portion and a side portion of the head of a user.

A main direction of the transition is indicated by an arrow designated by 116. Along the arrow 116, a change in hair length takes place. Perpendicular to the main direction 116, the respective hair length is basically constant.

Using an automated hair cutting appliance 20 to process the transition 114 is in some respect direction/orientation dependent. When a movement direction 120 that is basically parallel to the direction 116 of the slope or inclination is used to move the appliance 20 through the haired portion 108, then, at each position along the width extension (reference numeral 36 in FIG. 1) of the blade set 22, more or less the same hair length would be required. Hence, as the comb 24 typically defines a parallel offset from the blade set, the hair may be processed along the entire processing width 36 of the appliance 20. Consequently, as the appliance 20 is moved in the movement direction 120 through the transition 114, the cutting length may be adapted accordingly to form the desired slope.

By contrast, if the appliance 20 was moved in a movement direction 124 that is not parallel to the main direction 116 of the transition, basically an unsteady, varying cutting length along the processing width 36 of the appliance 20 would be necessary. However, as indicated before, as basically only a constant cutting length may be defined along the processing width 36, care must be taken not to cut the hair in the transition 114 too short.

Hence, when the appliance is moved in the moving direction 124 that is not parallel to the main direction 116 of the transition, it would be beneficial to observe more than only one length value along the processing width 36 of the appliance 20. Otherwise, it may not be totally unlikely that eventually the transition 114 is stepped rather than smooth.

Figure 6:
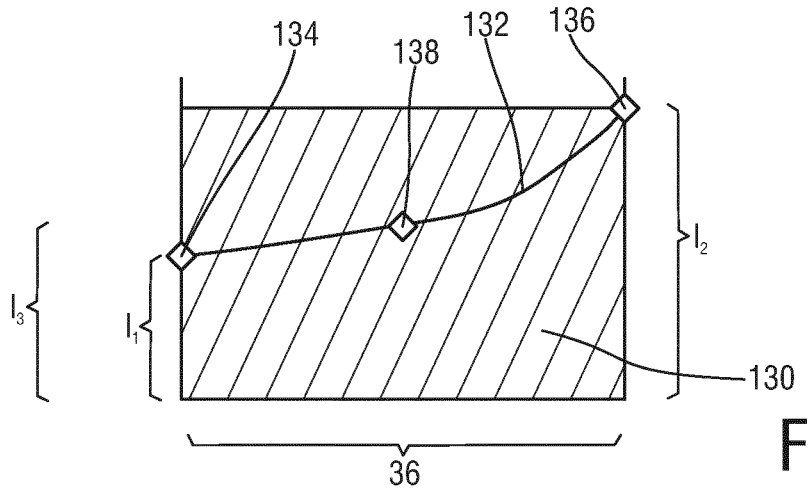
FIG. 6 is a simplified two-dimensional section of a hairstyle model, wherein an actual hair length is plotted over a present width extension of a blade set.
Figure 7:
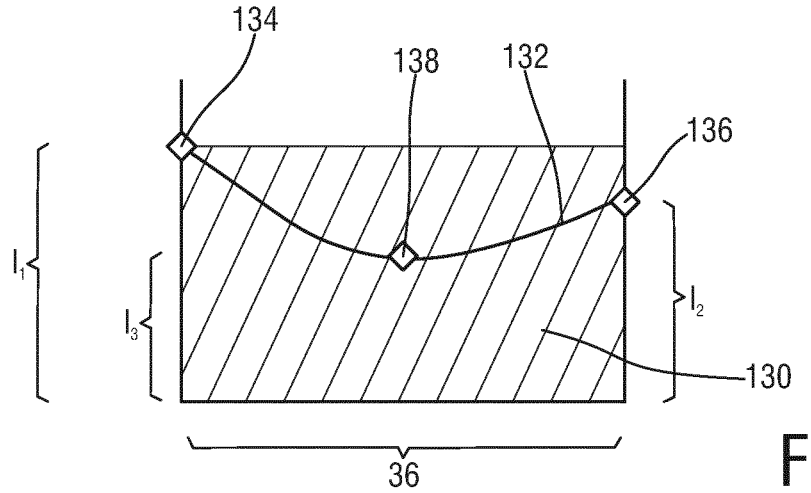
FIG. 7 shows a similar illustration as FIG. 6, wherein another exemplary hair length plot over a given width extension of a blade set is provided.
Figure 8:
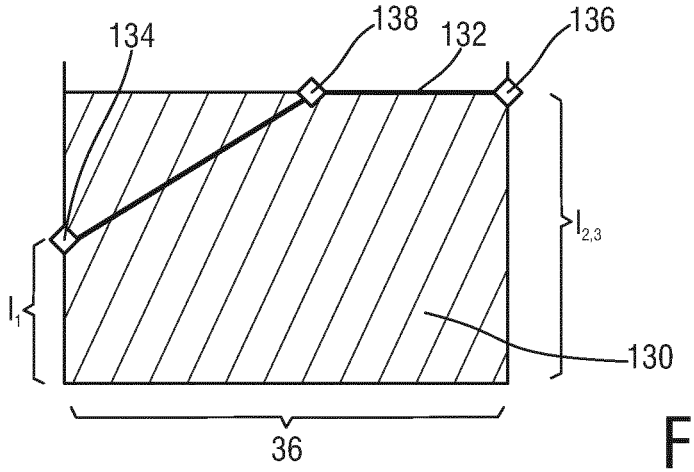
FIG. 8 shows yet a further exemplary hair length plot over a width extension of a blade set in accordance with the illustrations shown in FIG. 6 and FIG. 7.

Further reference is made to the exemplary simplified illustrations of FIG. 6, FIG. 7 and FIG. 8. Therein, a respective comb setting 130 for respective hair length curves/characteristics 132 is shown. In FIG. 6, FIG. 7 and FIG. 8, the orientation of the views corresponds to the perspective of the processing head of the hair processing appliance 20. Consequently, the section of the hair length model 94 (refer to FIG. 4 and FIG. 5) that is represented by the curves 132 has an extension that corresponds to the processing width 36 of the blade set 22 of the appliance 20.

In any of FIG. 6, FIG. 7 and FIG. 8, along the width extension 36, three length values 134, 136, 138 are observed. In FIG. 6, a first value 134 is assigned to a first lateral end of the blade set. A second value 136 is assigned to an opposite, second lateral end of the blade set 22. Further, a third value 138 is assigned to a central region of the width extension 36 of the blade set 22. Needless to say, a new alternative, also two, four or even more values may be observed for setting the current comb setting 130 that defines the present cutting length.

Similarly, also in FIG. 7 and FIG. 8, three length values 134, 136, 138 are observed, respectively.

The first value in FIG. 6 corresponds to a first length $l_1$. The second value 136 corresponds to a second length $l_2$. The third value 138 corresponds to a third length $l_3$. The same applies to the exemplary illustrations of FIG. 7 and FIG. 8.

In FIG. 6, the shortest length is the value $l_1$. The greatest length along the width 36 of the blade set 22 is the second value $l_2$. Consequently, to avoid that any hair along the curve 132 is cut too short, the adjustable comb is set to a length corresponding to the value $l_2$. Consequently, while hairs becoming too short is prevented, major regions of the observed width extension require further processing so as to eventually meet the desired hair length characteristics 132 for the entire section.

Similarly, in FIG. 7, the three values 134, 136, 138 are observed, wherein the first length $l_1$ is the greatest length along the width extension. Consequently, the comb setting 130 is adapted to the length $l_1$.

In FIG. 8, both the values 136 and 138 represent more or less the same length $l_{2,3}$ that is the greatest length along the observed "window". Hence, the comb setting 130 is adapted to the length $l_{2,3}$.

Figure 9:
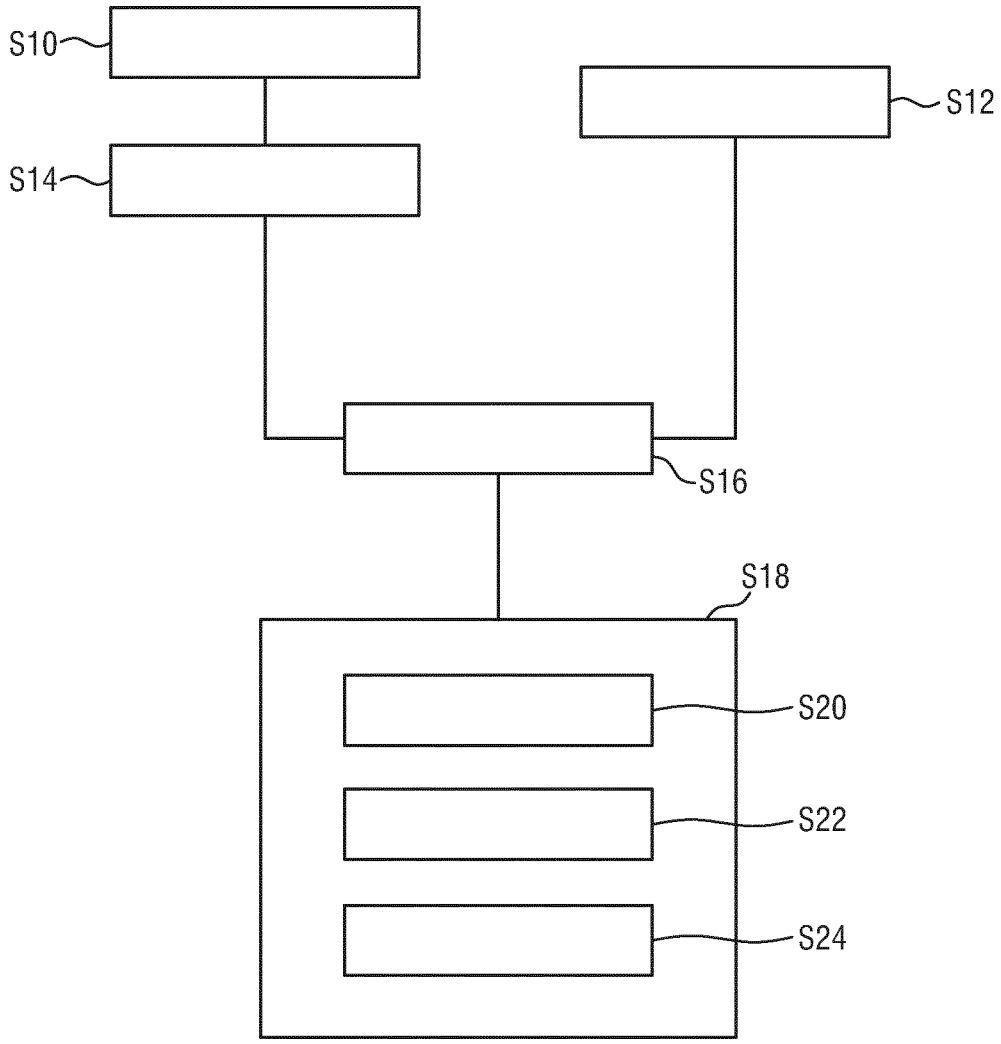
FIG. 9 shows a simplified block diagram of an embodiment of a method of operating an automated grooming appliance in accordance with the present disclosure.

Further reference is made to FIG. 9, schematically illustrating an exemplary embodiment of a method of operating an automated grooming appliance. The method comprises a step S10 relating to the provision of an automated grooming appliance, particularly an automated hair cutting appliance. Generally, the appliance is provided with a motorized adjustable comb that is capable of defining a desired cutting length by spacing the comb away from a blade set of the appliance.

In a further provision step S12, a hairstyle model which may also be referred to as hair length topology model is provided. The hairstyle model correlates a scalp model/head model and an associated hair length model. Hence, information as to which hair length is actually required at a certain region of the head is provided. Hence, the adjustable comb of the appliance may be operated accordingly to define the desired length setting for the respective portion of the head of the user.

To this end, it is required to detect and track the position of the appliance, step S14. In the step S14, further orientation indicative information is detected. This may involve a direct or mediate detection of the orientation of the blade set of the appliance with respect to the user whose hair is to be processed. As indicated above, as the blade set of the appliance generally has a certain width extension, it is beneficial to detect the orientation of the blade set since otherwise transitions, fades and further portions of varying hair lengths are difficult to process. To avoid sharp edges and steps in transition regions, it is proposed to set the current length setting to the greatest length value along the current width 36 of the blade set 22. Hence, cutting any hairs in the observed window too short may be prevented in this way.

In a further step S16, the model data provided in the step S12 and the position/orientation information obtained in the step S14 is correlated. Hence, the currently required length setting may be defined.

Accordingly, the appliance may be operated in an operating step S18. The operating step S18 comprises several sub-steps S20, S22, S24. In the sub-step S20, a plurality of length values along the width extension of the blade set is observed. This may involve, for instance, respective values at or adjacent to a first lateral end and a second lateral end of the blade set. In addition, in some embodiments, at least one length value from a central portion of the blade set width extension may be observed.

In a further sub-step S22, a value from the plurality of values may be selected to set the length setting accordingly. Generally, in major embodiments, the greatest length value among the observed values for the width extension of the blade set is selected. In this way, cutting hairs too short may be prevented.

In the sub-step S24, the length adjustment is operated accordingly. Hence, the motorized adjustment comb may be controlled so as to define the currently required length setting.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

A computer program may be stored/distributed on a suitable medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. An automated grooming appliance for hair processing procedures, the appliance comprising:

a processing head including a blade set having a processing width, a length setting unit that is operatively coupled to the blade set, and a control unit that is arranged to operate the length setting unit based on a hairstyle model that correlates position data and hair processing data, wherein the control unit is arranged to adjust a length setting dependent on an actual position and an actual orientation of the blade set, and wherein the control unit is operable to set the length setting unit to a selected value of a number of observed length values provided by the hairstyle model for the actual position and orientation, and for a given width extension of the blade set.

2. The appliance as claimed in claim 1, wherein the hairstyle model involves a hairstyle map that includes a head topology and an assigned hair length setting that represents a model haircut.

3. The appliance as claimed in claim 1, wherein the control unit is operable to set the length setting unit to a selected value of a series of length values provided by the hairstyle model that are distributed along a processing width extension of the blade set.

4. The appliance as claimed in claim 1, wherein the selected value is a maximum value of any observed value.

5. The appliance as claimed in claim 1, wherein the control unit is operable to adjust the length setting based on an evaluation of two or more length values provided by the hairstyle model for the actual position, orientation and processing width extension of the blade set.

6. The appliance as claimed in claim 5, wherein the control unit is arranged to adjust the length setting based on an evaluation of three or more length values, wherein a first length value of the length values is assigned to a first lateral end of the blade set, wherein a second length value of the length values is assigned to a second lateral end of the blade set, wherein a third length value of the length values is assigned to a central portion of the blade set between the first lateral end and the second lateral end, and wherein a maximum value of the first length value, the second length value and the third length value is used to set the length setting unit.

7. The appliance as claimed in claim 1, wherein the control unit is operable to be provided with position information supplied by a position detection unit.

8. The appliance as claimed in claim 7, wherein the control unit is operable to be provided with orientation information supplied by the position detection unit.

9. The appliance as claimed in claim 1, wherein the control unit is operable to be provided with orientation information supplied by an orientation detection unit.

10. The appliance as claimed in claim 9, wherein the orientation information includes absolute orientation information and/or relative orientation information.

11. The appliance as claimed in claim 1, further comprising a hand piece arranged to be moved through hair to cut hair, wherein the processing head is formed at or attached to the hand piece.

12. A use of an appliance as claimed in claim 1 in a hair cutting procedure for processing a length transition region.

13. The appliance as claimed in claim 1, wherein the actual orientation of the blade set is determined by an evaluation of a current movement direction or vector of the appliance.

14. An automated hair processing system, comprising:

a grooming appliance as claimed in claim 1, a position detection unit that is arranged to detect and track a position and an orientation of the appliance with respect to a user, wherein the control unit is arranged to correlate position information and orientation information with a present hairstyle model, wherein the length setting is set under consideration of the position and the orientation of the blade set of the appliance with respect to a user to account for a non-constant length provided by the hairstyle model for a current operating zone along the extension of the blade set.

15. A method of operating an automated grooming appliance, comprising the following steps:

providing a grooming appliance comprising a processing head including a blade set having a processing width, and a length setting unit that is operatively coupled to the blade set, controlling the length setting unit based on a hairstyle model that correlates position data and hair processing data, wherein the step of controlling involves adjusting a length setting dependent on an actual position and an actual orientation of the blade set, and, setting the length setting unit to a selected value of a number of observed length values provided by the hairstyle model for the actual position and orientation, and for a given width extension of the blade set.

16. The method as claimed in claim 15, further comprising the step of setting the length setting unit to a selected value of a series of length values provided by the hairstyle model that are distributed along a processing width extension of the blade set, wherein the selected value is a maximum value of any observed value.

17. A computer program comprising program code means for causing a computer to carry out the steps of the method as claimed in claim 15 when said computer program is carried out on a computing device.

* * * * *